US011446795B2

(12) United States Patent
Chen

(10) Patent No.: US 11,446,795 B2
(45) Date of Patent: Sep. 20, 2022

(54) DOUBLE-SIDED, DETACHABLE WRENCH

(71) Applicant: JS Products, Inc., Las Vegas, NV (US)

(72) Inventor: Chungeng Chen, Las Vegas, NV (US)

(73) Assignee: JS Products, Inc., Las Vegas, NV (US)

( * ) Notice: Subject to any disclaimer, the term of this patent is extended or adjusted under 35 U.S.C. 154(b) by 359 days.

(21) Appl. No.: 16/821,909

(22) Filed: Mar. 17, 2020

(65) Prior Publication Data

US 2020/0298381 A1 Sep. 24, 2020

Related U.S. Application Data

(60) Provisional application No. 62/913,513, filed on Oct. 10, 2019, provisional application No. 62/868,798, filed on Jun. 28, 2019, provisional application No. 62/821,421, filed on Mar. 20, 2019.

(51) Int. Cl.

| | |
|---|---|
| ***B25B 23/00*** | (2006.01) |
| ***B25B 23/16*** | (2006.01) |
| ***B25B 13/08*** | (2006.01) |

(52) U.S. Cl.

CPC ..... *B25B 23/0007* (2013.01); *B25B 13/08* (2013.01); *B25B 23/16* (2013.01)

(58) Field of Classification Search

CPC ..... B25B 23/0007; B25B 23/16; B25B 13/06; B25B 13/08

See application file for complete search history.

(56) References Cited

U.S. PATENT DOCUMENTS

| | | | | |
|---|---|---|---|---|
| 849,891 | A | 4/1907 | Ellingson | B25B 13/48 |
| 1,003,997 | A | 9/1911 | Dudly | B25B 13/08 |
| 1,747,527 | A | 2/1930 | Peterson | B25B 13/08 |
| 2,142,589 | A | 1/1939 | Olson | B25B 13/56 |
| D338,816 | S | 8/1993 | Maldonado | |
| 5,492,040 | A | 2/1996 | Bellas | B25B 13/00 |
| 5,520,074 | A | 5/1996 | Swindell, Sr. | B25G 1/043 |
| D417,374 | S | 12/1999 | Chen | |
| D462,245 | S | 9/2002 | Friedman et al. | |
| 6,523,440 | B2 | 2/2003 | Friedman et al. | B25B 13/04 |
| D473,768 | S | 4/2003 | Gilmore | |
| 6,691,595 | B2 | 2/2004 | Hsien | B25B 13/04 |
| 7,024,969 | B2 | 4/2006 | Smith | B25B 13/08 |
| 7,316,172 | B1 | 1/2008 | Chen et al. | B25B 13/56 |
| 7,530,295 | B2 | 5/2009 | Jones et al. | B25F 1/00 |
| 8,136,427 | B2 | 3/2012 | James | B25G 1/063 |
| 9,199,363 | B2 | 12/2015 | Chen | B25B 23/0042 |
| 2010/0175514 | A1 | 7/2010 | Hsieh | B25G 1/043 |
| 2012/0174718 | A1 | 7/2012 | James | B25B 13/08 |
| 2017/0203419 | A1 | 7/2017 | White, II | B25G 1/043 |

*Primary Examiner* — David B. Thomas

(74) *Attorney, Agent, or Firm* — Weide & Miller, Ltd.

(57) ABSTRACT

A double-sided, detachable tool includes a first tool half and a second tool half. The first tool half has a first tool head on a first end, a first stepped profile on a bottom surface, and a latch protruding from the bottom surface. The second tool half has a second tool head on its first end, a second stepped profile on its bottom surface, and a latching aperture extending through the second tool half from its top side to the bottom side. The latch is inserted into the latching aperture to connect the first tool half to the second tool half and is removed from the latching aperture to detach the first tool half from the second tool half. The transitions from the stepped profiles to the seconds ends of the tool halves create a substantially flush surface therebetween.

20 Claims, 7 Drawing Sheets

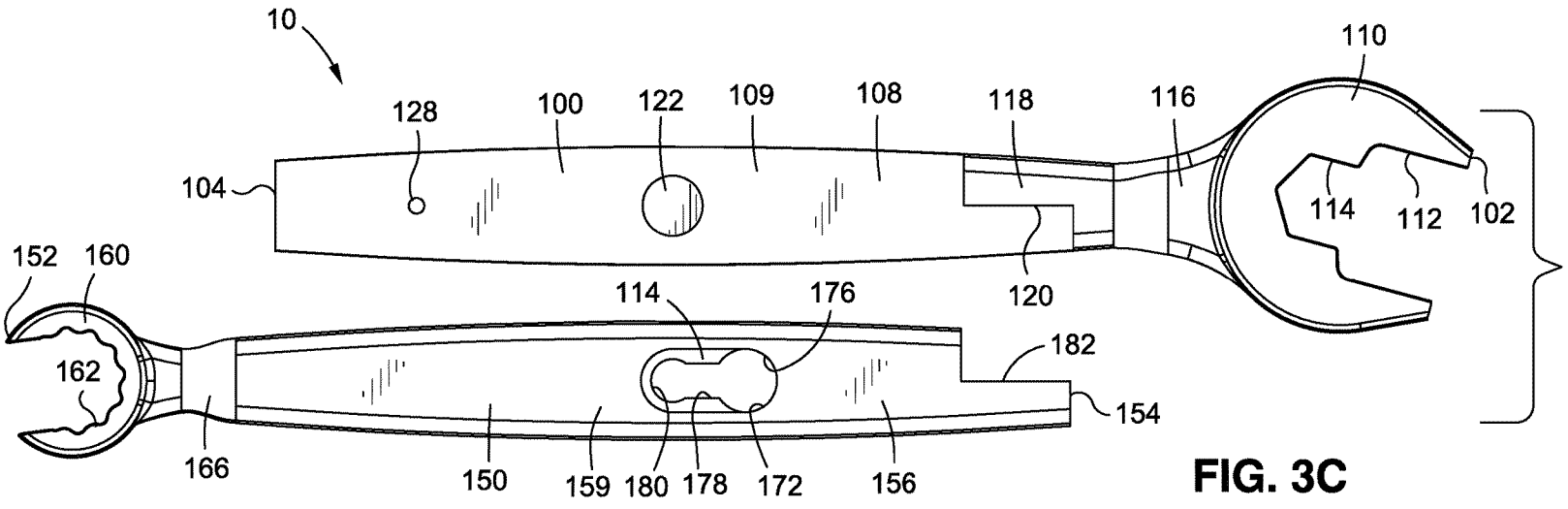
FIG. 3C
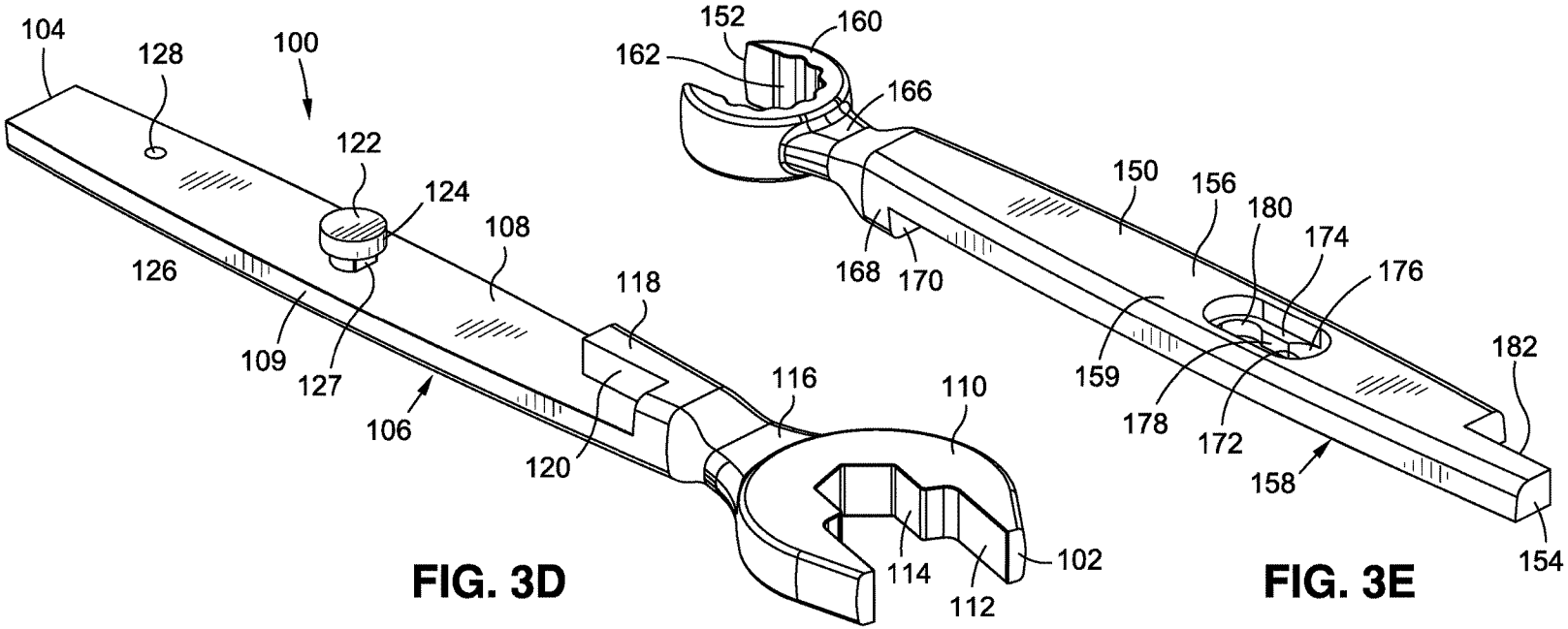
FIG. 3D
FIG. 3E

DOUBLE-SIDED, DETACHABLE WRENCH

CROSS-REFERENCE TO RELATED APPLICATIONS

This application claims the benefit of U.S. Provisional Application No. 62/821,421 which was filed on Mar. 20, 2019; U.S. Provisional Application No. 62/868,798 which was filed on Jun. 28, 2019; and U.S. Provisional Application No. 62/913,513 which was filed on Oct. 10, 2019, the contents each of which are incorporated by reference.

BACKGROUND

The disclosed embodiments relate to hand tools, and more specifically relate to double-sided, detachable hand tools.

In many industries, there are common sizes of fasteners and/or fittings. For example, home improvement applications may utilize standard sizes of fasteners, such as a quarter-inch fastener. Such fasteners may include standard sizes of heads and corresponding nuts. As another example in plumbing applications, there are common sizes of fittings for use in bathroom and kitchen angle-stop valves.

Accordingly, tools have been provided such as a detachable wrench shown in U.S. Pat. No. 6,523,440. There a coupling wrench includes detachable members where a second member screws into a first member. The coupling wrench provides a single tool that is easy to carry as a single item. The members detach from one another via the corresponding threads in the members so that both heads of the members may be used simultaneously, such as to work with angle stops or straight stop valves. The heads are sized to include for the standard sizes of fastener heads used in the industry.

However, there are several drawbacks to the above described tool. First, the tool may be difficult to manufacture due to the need to blindly drill and tap the inside of the first member to receive the second member. Further, due to the threaded connection, it is difficult to manufacture the tool such that the two heads are parallel with each other when the members are connected. Finally, the threaded connection of the two makes it tedious to connect and disconnect the members.

SUMMARY

Given the foregoing, the disclosed embodiments herein provide a double-sided, detachable wrench is provided that may be easily carried as a single item while also being easily detachable into its respective parts. Further, the connection and structure of the wrench allows for confident use by the user while in the connected state.

In one exemplary embodiment, a double-sided, detachable tool includes a first tool half having a first end, a second end opposite the first end, a top surface, and a bottom surface opposite the top surface. A first tool head is disposed at the first end of the first tool half, a first stepped profile is disposed on the bottom surface of the first tool half, and a latch is disposed on the bottom surface of the first tool half.

The tool further comprises a second tool half having a first end, a second end opposite the first end, a top surface, and a bottom surface opposite the top surface. A second tool head is disposed at the first end of the second tool half, a second stepped profile is disposed on the bottom surface of the second tool half, and a latching aperture extends through the second tool half from the top side to the bottom side.

The latch may be inserted into the latching aperture to connect the first tool half to the second tool half. The latch may be removed from the latching aperture to detach the first tool half from the second tool half.

When the first and second tool halves are connected, the second end of the first tool half is adjacent to the second stepped profile of the second tool half. The top surface of the first tool half is substantially flush with the second stepped profile of the second tool half. Similarly, the second end of the second tool half is adjacent to the first stepped profile of the first tool half. The top surface of the second tool half is substantially flush with the first stepped profile of the first tool half.

In one embodiment, the latching aperture may include a counterbored, flanged profile. The flanged profile has a large annular profile, a small annular profile, and a slot extending between the large annular profile and the small annular profile. The latch may include an annular flange disposed on top of a keyed extension that has two parallel flat surfaces. The annular flange is configured to fit into the large annular profile, and the two parallel flat surfaces are sized to fit into the slot. When the first tool half is connected to the second tool half, a top of the annular flange is substantially flush with the top surface of the second tool half. The two parallel flat surfaces may only fit into the slot when the first tool half is substantially perpendicular to the second tool half.

In another embodiment, the first stepped profile of the first tool half comprises a z-shaped profile. The second end of the second tool half is formed in a corresponding z-shaped profile to the z-shaped profile of the first tool half.

The first tool head on the first end of the first tool half may include a first opening having a first size and a second opening having a second size. The second tool head disposed on the first end of the second tool half may include a multi-point box head or may have a third opening of the second size.

In some embodiments, the first tool half may have a catch rod disposed at the second end of the first tool half where the catch rod is biased outward from the second end of the first tool half. The second stepped profile of the second tool half may include a u-shaped slot. The catch rod may then be biased into the u-shaped slot when the first tool half is connected to the second tool half.

The first tool half may comprise a catch release switch that is connected to the catch rod. The catch release switch may be operable to move the catch rod out of the u-shaped slot and into the second end of the first tool half. With the catch rod clear of the u-shaped slot, relative rotation between the first tool half and the second tool half is enabled.

According to another exemplary embodiment, a double sided, detachable tool may include a first tool half having a first end, a second end opposite the first end, a top surface, and a bottom surface opposite the top surface. The first tool half includes a first tool head disposed at the first end of the first tool half, a first stepped profile disposed on the bottom surface of the first tool half, the first stepped profile being formed in a z-shape, and a latch disposed on the bottom surface of the first tool half.

The tool may further comprise a second tool half having a first end, a second end opposite the first end, a top surface, and a bottom surface opposite the top surface. The second tool half includes a second tool head disposed at the first end of the second tool half, a second stepped profile disposed on the bottom surface of the second tool half, and a latching aperture extending through the second tool half from the top side to the bottom side.

The latch may be inserted into the latching aperture to connect the first tool half to the second tool half. The latch may be removed from the latching aperture to detach the first tool half from the second tool half.

The second end of the second tool half is formed in a corresponding z-shaped profile to the first stepped profile. The corresponding z-shaped profile is adjacent to the first stepped profile when the first tool half is connected to the second tool half.

When the first tool half is connected to the second tool half, the second end of the first tool half is adjacent to the second stepped profile of the second tool half. In that position, the top surface of the first tool half is substantially flush with the second stepped profile of the second tool half. The top surface of the second tool half is also substantially flush with the first stepped profile of the first tool half.

The latching aperture may include a counterbored, flanged profile. The flanged profile has a large annular profile, a small annular profile, and a slot extending between the large annular profile and the small annular profile. The latch comprises an annular flange disposed on a keyed extension that has two parallel flat surfaces. The annular flange is configured to fit into the large annular profile and the two parallel flat surfaces are configured to fit into the slot.

When the first tool half is connected to the second tool half, a top of the annular flange is substantially flush with the top surface of the second tool half. The two parallel flat surfaces only fit into the slot when the first tool half is substantially perpendicular to the second tool half.

According to another exemplary embodiment, a double sided, detachable tool includes a first tool half having a first end, a second end opposite the first end, a top surface, and a bottom surface opposite the top surface. The first tool half includes a first tool head disposed at the first end of the first tool half, a first stepped profile disposed on the bottom surface of the first tool half, a latch disposed on the bottom surface of the first tool half, and a catch rod disposed at the second end of the first tool half, the catch rod being biased outward from the second end of the first tool half.

The tool further includes a second tool half having a first end, a second end opposite the first end, a top surface, and a bottom surface opposite the top surface. The second tool half may include a second tool head disposed at the first end of the second tool half, a second stepped profile disposed on the bottom surface of the second tool half, the second stepped profile of the second tool half comprising a u-shaped slot, and a latching aperture extending through the second tool half from the top side to the bottom side.

The latch may be inserted into the latching aperture to connect the first tool half to the second tool half. The latch may be removed from the latching aperture to detach the first tool half from the second tool half. The catch rod may be biased into the u-shaped slot when the first tool half is connected to the second tool half.

When the first tool half is connected to the second tool half, the second end of the first tool half is adjacent to the second stepped profile of the second tool half. In this position, the top surface of the first tool half is substantially flush with the second stepped profile of the second tool half. Similarly, when the tool halves are connected, the second end of the second tool half is adjacent to the first stepped profile of the first tool half. In this position, the top surface of the second tool half is substantially flush with the first stepped profile of the first tool half.

The latching aperture may include a counterbored, flanged profile. The flanged profile may include a large annular profile, a small annular profile, and a slot extending between the large annular profile and the small annular profile. The latch may include an annular flange disposed on a keyed extension that has two parallel flat surfaces. The annular flange may be configured to fit into the large annular profile, and the two parallel flat surfaces are configured to fit into the slot.

When the first tool half is connected to the second tool half, a top of the annular flange is substantially flush with the top surface of the second tool half. The two parallel flat surfaces only fit into the slot when the first tool half is substantially perpendicular to the second tool half.

BRIEF DESCRIPTION OF THE DRAWINGS

FIG. 1 shows a double-sided, detachable wrench in a connected state, according to one exemplary embodiment.

FIG. 2 shows an alternate view of the double-sided, detachable wrench shown in

FIG. 1.

FIG. 3A, FIG. 3B, FIG. 3C, FIG. 3D and FIG. 3E show views of the double-sided, detachable wrench of FIG. 1 in a detached state.

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

Figures 1, 2:
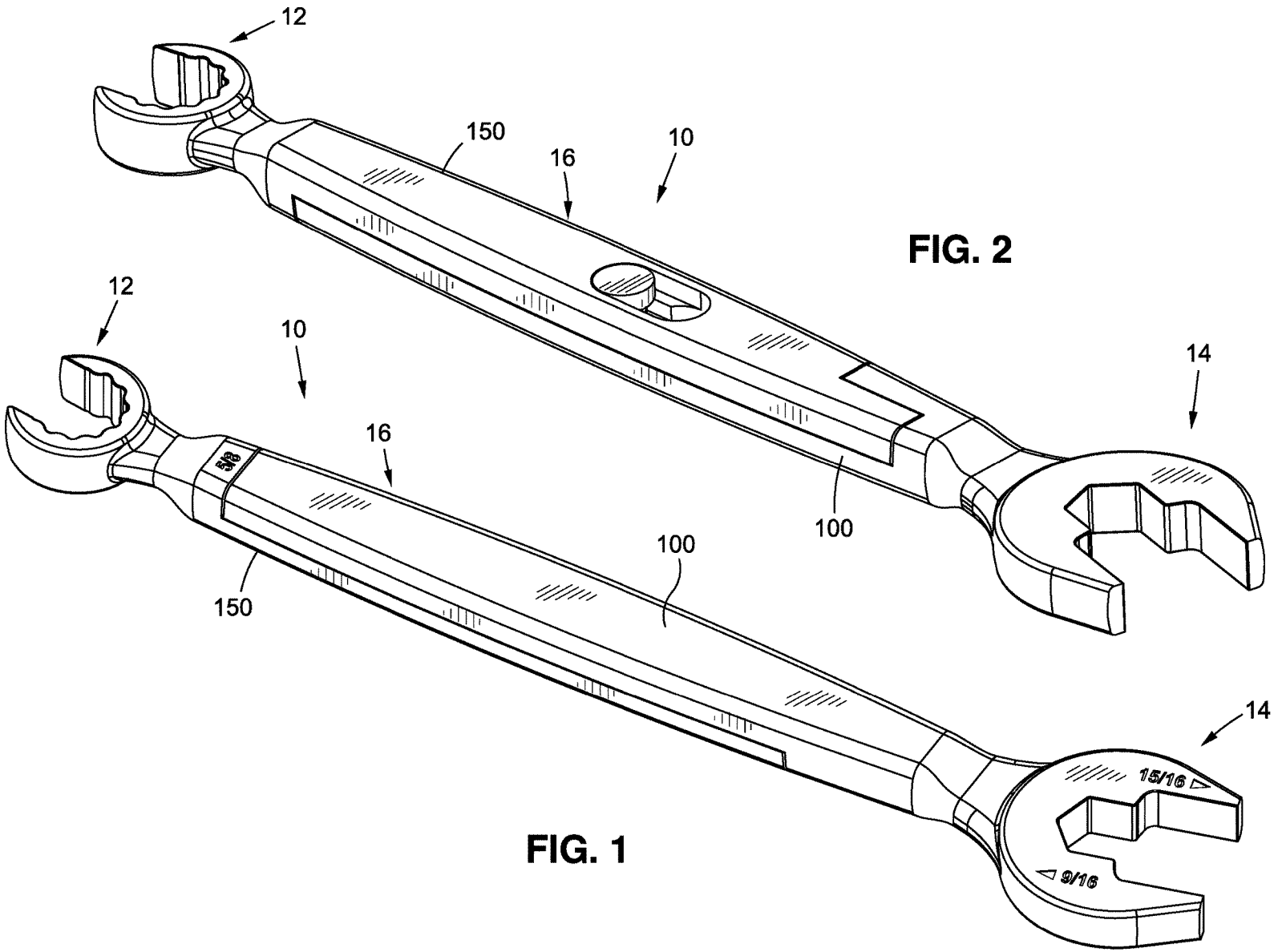

FIG. 1 shows a double-sided, detachable wrench in a connected state, according to one exemplary embodiment, and FIG. 2 shows an alternate view of the double-sided, detachable wrench shown in FIG. 1. A wrench 10 comprises a first end 12, a second end 14, and a handle 16. The wrench is comprised of two, detachable parts including a first wrench half 100 and a second wrench half 150. The connection between the first wrench half 100 and the second wrench half 150 allow for a smooth and ergonomic handle 16, as shown in FIGS. 1 and 2.

The wrench 10 may be formed from any suitable material as is now known or later developed in the art such as steel, aluminum, or other metals or alloys thereof. In some instances, other materials may be used such as polymer based materials including various plastic materials. The wrench 10 may be built according to known manufacturing processes such as through one or more of forging, casting, machining, and the like.

Figure 3A:
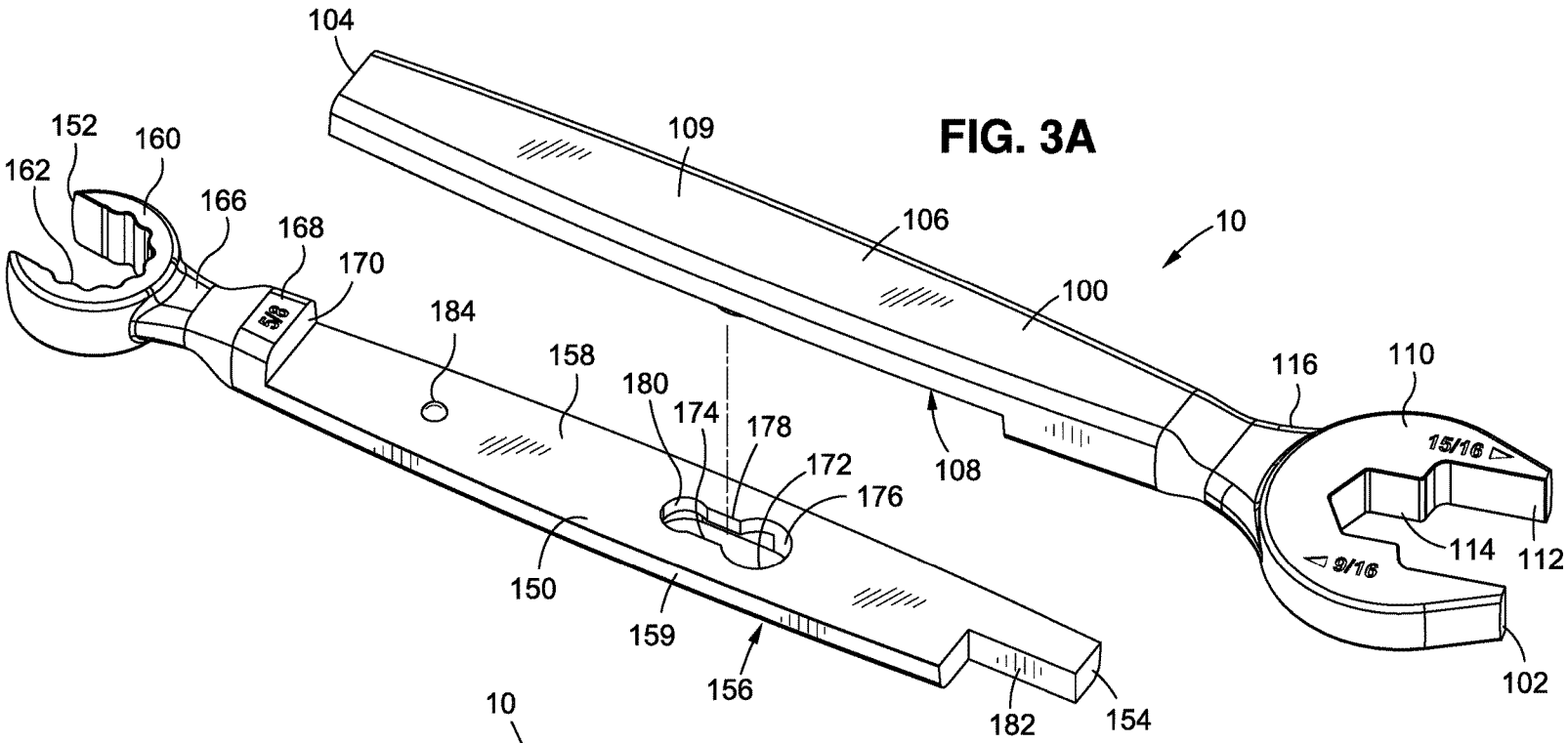
Figure 3B:
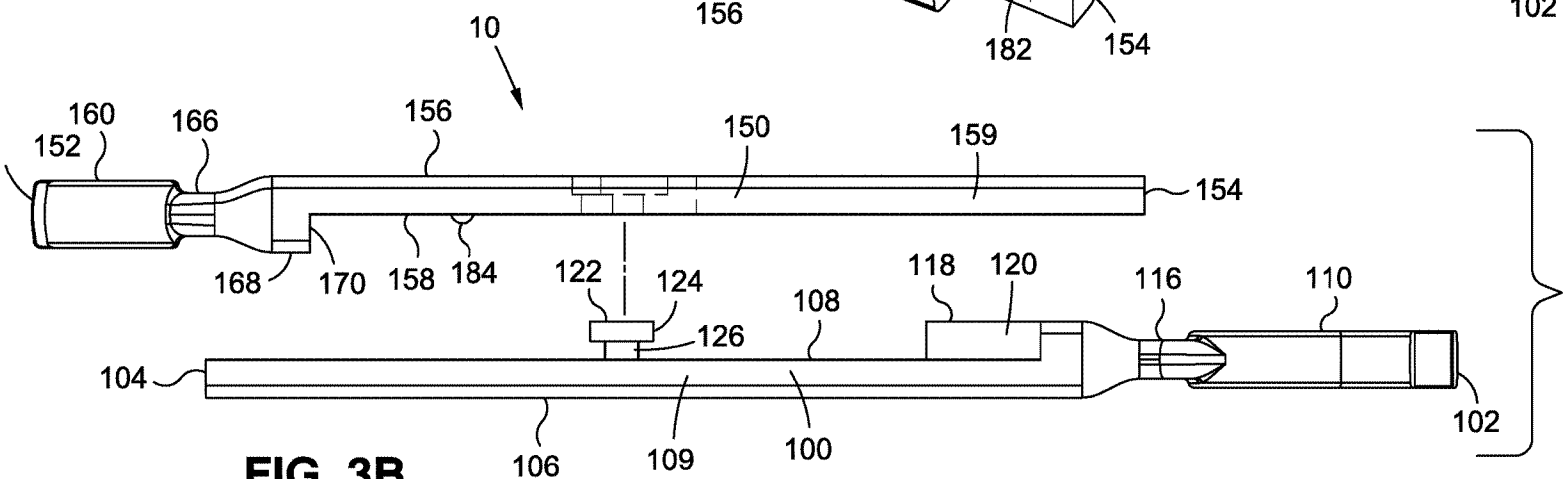

FIG. 3A, FIG. 3B, and FIG. 3C show views of the double-sided, detachable wrench of FIG. 1 in a detached state. FIGS. 3D and 3E show perspective views of the each of the wrench halves, respectively. As mentioned above the wrench 10 includes a first wrench half 100 and a second wrench half 150. The first wrench half 100 comprises a first end 102, a second end 104 opposite the first end 102, a top face 106, and a bottom face 108 opposite the top face 106. The first end 102 comprises a tool head 110. A handle portion 109 extends from the tool head 110 toward the second end 104.

In this embodiment, the tool head 110 comprises a first opening 112 having a first size, and a second opening 114 having a second size that is smaller than the first size. The first and second openings are preferable sized to fit standard fasteners. For example, the wrench 10 may be used for plumbing applications, and the first and second sizes are chosen to match the most common fastener sizes used in household plumbing applications. In one example, the sizes may be 15/16 of an inch and 9/16 of an inch, respectively.

The first wrench half 100 further comprises a neck portion 116 that serves as a transition from the tool head 110 to the handle portion 109. The handle portion 109 forms one half of the handle 16 (See FIGS. 1 and 2). As shown in FIG. 3B, the handle portion 109 is formed such that the bottom face 108 comprises a stepped portion 118. The handle portion 109 thus has a first thickness at the stepped portion 118 that is substantially the same thickness as the entire handle 16 (See FIGS. 1 and 2) and a second thickness from the stepped portion 118 towards the second 104. The second thickness is approximately half of the first thickness.

As shown in FIGS. 3C and 3D, the stepped portion 118 is formed with a Z-shaped profile to provide a stop for the second wrench half 150, as will be described in more detail below. The first wrench half 100 further comprises a latch 122 extending from the bottom face 108. The latch 122 has a keyed extension 126 shaped substantially cylindrical with parallel flat surfaces 127 formed on two sides thereof (see FIG. 3D). An annular flange 124 is formed on top of the keyed extension 126. The latch 122 helps connect the first wrench half 100 to the second wrench half 150, as will be described in more detail below. The bottom face 108 of the first wrench half 100 may further comprise an indented portion 128 that corresponds to a projection in the second wrench half 150 to stabilize the connection between the first wrench half 100 and the second wrench half 150.

Referring again to FIGS. 3A-3C, the second wrench half 150 comprises a first end 152, a second end 154 opposite the first end 152, a top face 156, and a bottom face 158 opposite the top face 156. The first end 152 comprises a tool head 160. A handle portion 159 extends from the tool head 160 toward the second end 154.

In this embodiment, the tool head 160 may be of a design characterized as a split-box wrench. The tool head 160 comprises a multi-point box head 162 for engaging a mechanical device having a given minimum diameter. In one example related to household plumbing, the multi-point box head 162 is suitable for wrenching a device with an approximately 5/8 inch (16 mm) diameter. Of course, other sizes and shapes may be utilized on the tool head 160. The split-box wrench is preferably a well-known 12-point design, suitable for engaging and wrenching hexagonal fittings and to tighten or loosen a compression nut.

The second wrench half 150 further comprises a neck portion 166 that serves as a transition from the tool head 150 to the handle portion 159. The handle portion 159 forms one half of the handle 16 (See FIGS. 1 and 2). As shown in FIG. 3B, the handle portion 159 is formed such that the bottom face 158 comprises a stepped portion 168. The handle portion 159 thus has a first thickness at the stepped portion 168 that is substantially the same thickness as the entire handle 16 (See FIGS. 1 and 2) and a second thickness from the stepped portion 168 towards the second end 154. The second thickness is approximately half of the first thickness.

As shown in FIGS. 3A, 3C, and 3E, the stepped portion 168 is formed by a face 170 perpendicular to a longitudinal axis defined by the tool 10 to allow the second end 104 of the first wrench half 100 to slide adjacent thereto, as will be described in more detail below. The second wrench half 150 further comprises a latching aperture 172 extending through the bottom face 158 to the top face 156. The latching aperture 172 is counterbored to form a sunken, flanged profile 174. The flanged profile 174 comprises a large annular aperture 176, a slot 174, and a small annular aperture 180.

The second end 154 of the second wrench half 150 is formed with a z-shaped profile 182 to correspond with the z-shaped profile 120 of the first wrench half. The bottom surface 158 comprises a projection 184 that corresponds with the indent 128 of the first wrench half 100 to stabilize the connection between the first wrench half 100 and the second wrench half 150.

Figure 4:
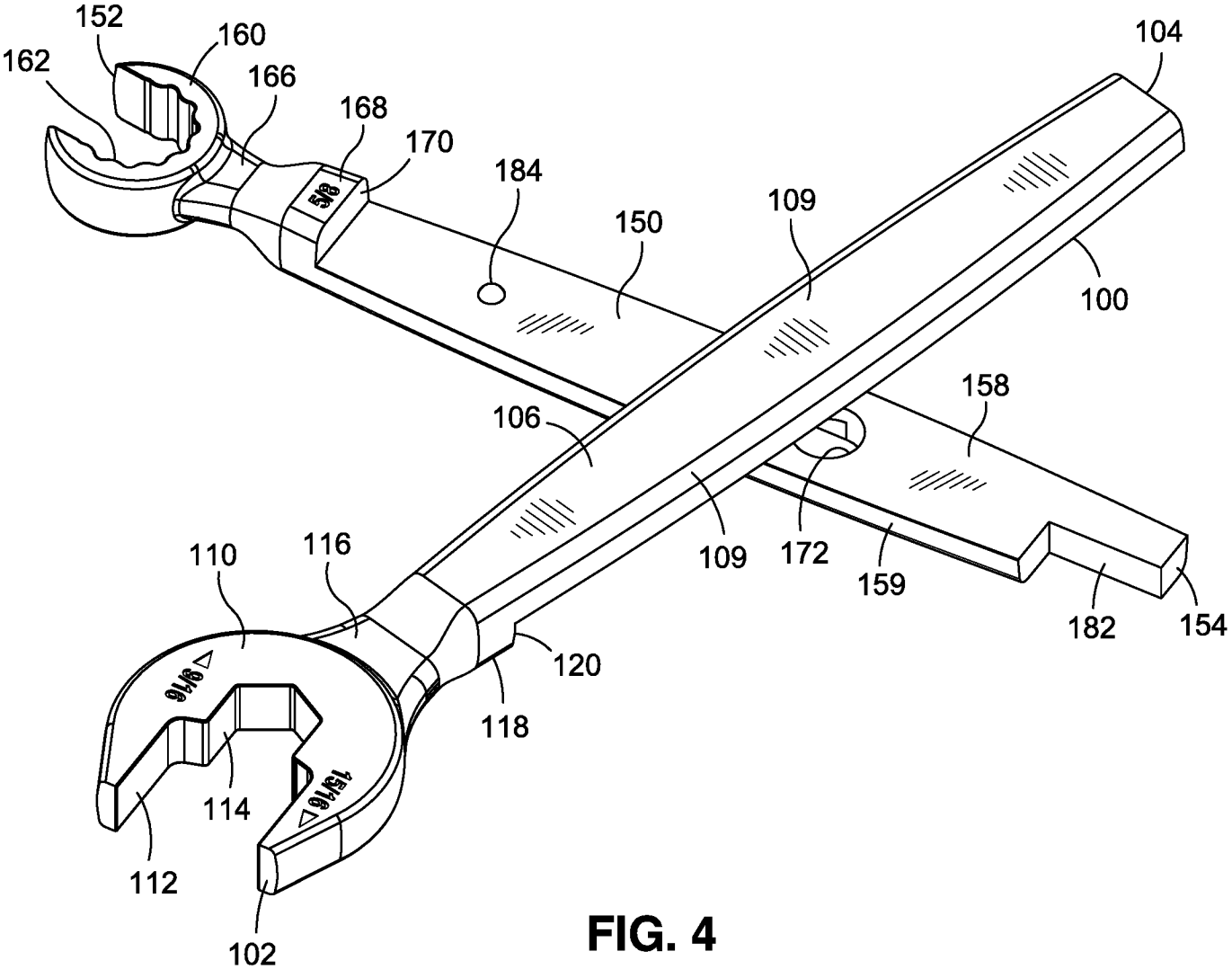
FIG. 4 illustrates a method of detaching and attaching a double-sided, detachable wrench, according to one exemplary embodiment.

FIG. 4 illustrates a method of detaching and attaching a double-sided, detachable wrench, according to one exemplary embodiment. As shown in FIG. 4 the first wrench half 100 may attach to and detach from the second wrench half 150. First, the first wrench half 100 and the second wrench half 150 are rotated to that they are generally perpendicular to one another. Specifically, when the first wrench half 100 is perpendicular to the second wrench half 150, the keyed extension 126 is oriented such that the parallel flat surfaces 127 are aligned with the slot 178 of the flanged profile 174 (when the first wrench half 100 and second wrench half 150 are generally perpendicular to one another, the keyed extension 126 will not pass from the small annular aperture 180 to the large annular aperture 176 because the dimension of the keyed extension 126 is larger in a direction perpendicular to the flat surfaces 127 than is the distance between the flat surfaces 127, and greater than the width of a slot 178 leading between the two apertures). At this orientation, the latch 122 may move through the latching aperture 172 from the small annular aperture 180 to the large annular aperture 176.

When the latch 122 is aligned with the large annular aperture 176, the first wrench half 100 may be removed from the second wrench half 150 (because the diameter of the large annular aperture 176 is greater than the diameter of the latch 122, including the flange 124). With the first wrench half 100 separated from the second wrench half 150, the tool head 110 of the first wrench half 100 and the tool head 160 of the second wrench half 150 may be used simultaneously. In one example, with the first wrench half 100 and the second wrench half 150 separated, a user may use both tool heads 110, 160 simultaneously, such as to adjust an angle stop or a straight stop valve (such as where the user grasps the first wrench half 100 in one hand and the second wrench half 150 in another hand). Furthermore, the profile 182 of the second end 154 of the second wrench half 150 may be such that the second end 154 is sized to fit within the inside diameter of a compression fitting.

To attach the first wrench half 100 to the second wrench half 150, the annular flange 124 of the latch 122 is inserted through the latching aperture 172 by aligning the annular flange 124 with the large annular aperture 176. The bottom surface 108 of the first wrench half 100 and the bottom surface 158 of the second wrench half 150 are placed adjacent to one another so that the annular flange 124 of the latch 122 clears the sunken, flanged profile 174. When the bottom surfaces 108, 158 are adjacent, the top of the annular flange 124 may be substantially flush with the top surface 156 of the second wrench half 150.

With the first wrench half 100 perpendicular to the second wrench half 150 and the parallel flat surfaces 127 aligned with the slot 178, the first wrench half 100 may be moved toward the first end 152 of the second wrench half 150 such that the keyed extension 126 of the latch 122 is aligned in the small annular aperture 180 of the flanged profile 174. Then, the first wrench half may be rotated so that the second end 104 of the first wrench half 100 is aligned with the stepped portion 168 of the second wrench half 150, and so that the profile 182 of the second end 154 of the second wrench half 150 may be brought adjacent to the profile 120 of the stepped portion 118 of the first wrench half 100 (as shown in FIGS. 1 and 2).

In this connected position, the annular flange 124 overlaps the small annular aperture 180 of the flanged profile 174 such that the first wrench half 100 cannot disconnect from the second wrench half 150. Further, the parallel flat surfaces 127 are not aligned with the slot 178, restricting relative longitudinal movement between the first wrench half 100 and the second wrench half 150. In the connected position, the user may operate the wrench 10 as a standard two-sided wrench. The corresponding z-profiles 120, 182 allow the user to still apply large forces to the wrench 10 without causing relative rotation of the first wrench half 100 and the second wrench half 150.

Modifications of the wrench 10 are also envisaged. For example, the corresponding z-shaped profiles may be included on the first end 12 of the wrench 10 as well as the second end 14. The latching aperture 172 and corresponding latch 122 may be switched on the first and second wrench halves 100, 150 respectively. Further, different types of tool heads may be used on the wrench 10 than those shown in FIGS. 1-4

In another exemplary embodiment, a double-sided, detachable wrench is provided which is suitable for common household tasks. The double-sided, detachable wrench may be used as a conventional two-sided wrench when in a connected state. Further, the two detachable sides may be used simultaneously when in a detached state, such as to tighten or loosen a nut and bolt.

It has been found that the most common fastener sizes typically correspond with the same size of head (bolt) and nut. These sizes are shown below in Table 1.

TABLE 1

Most Common Nut and Bolt Sizes

| | Head Width | Width Across Face | |
|---|---|---|---|
| Fastener Size | (Bolt) | (Finished Hex Nut) | (Heavy Duty Nut) |
| 1/4 | 7/16 | 7/16 | 1/2 |
| 5/16 | 1/2 | 1/2 | 9/16 |
| 3/8 | 9/16 | 9/16 | 11/16 |

Accordingly, the double-sided, detachable wrench may be offered in sizes that correspond to the most commonly used nut and bolt sizes, as shown in Table 2 below:

TABLE 2

Double-sided, Detachable Wrench Configurations

| Fastener Size | Wrench Head Two Opening Size | Wrench Head One Opening Sizes |
|---|---|---|
| 1/4 | 7/16 | 7/16, 1/2 |
| 5/16 | 1/2 | 1/2, 9/16 |
| 3/8 | 9/16 | 9/16, 11/16 |

A double-sided, detachable wrench may be constructed similarly to the wrench 10 described above with reference to FIGS. 1-4. As an alternative, the wrench may be constructed as shown in FIGS. 5-7 as described below.

Figures 5, 6A:
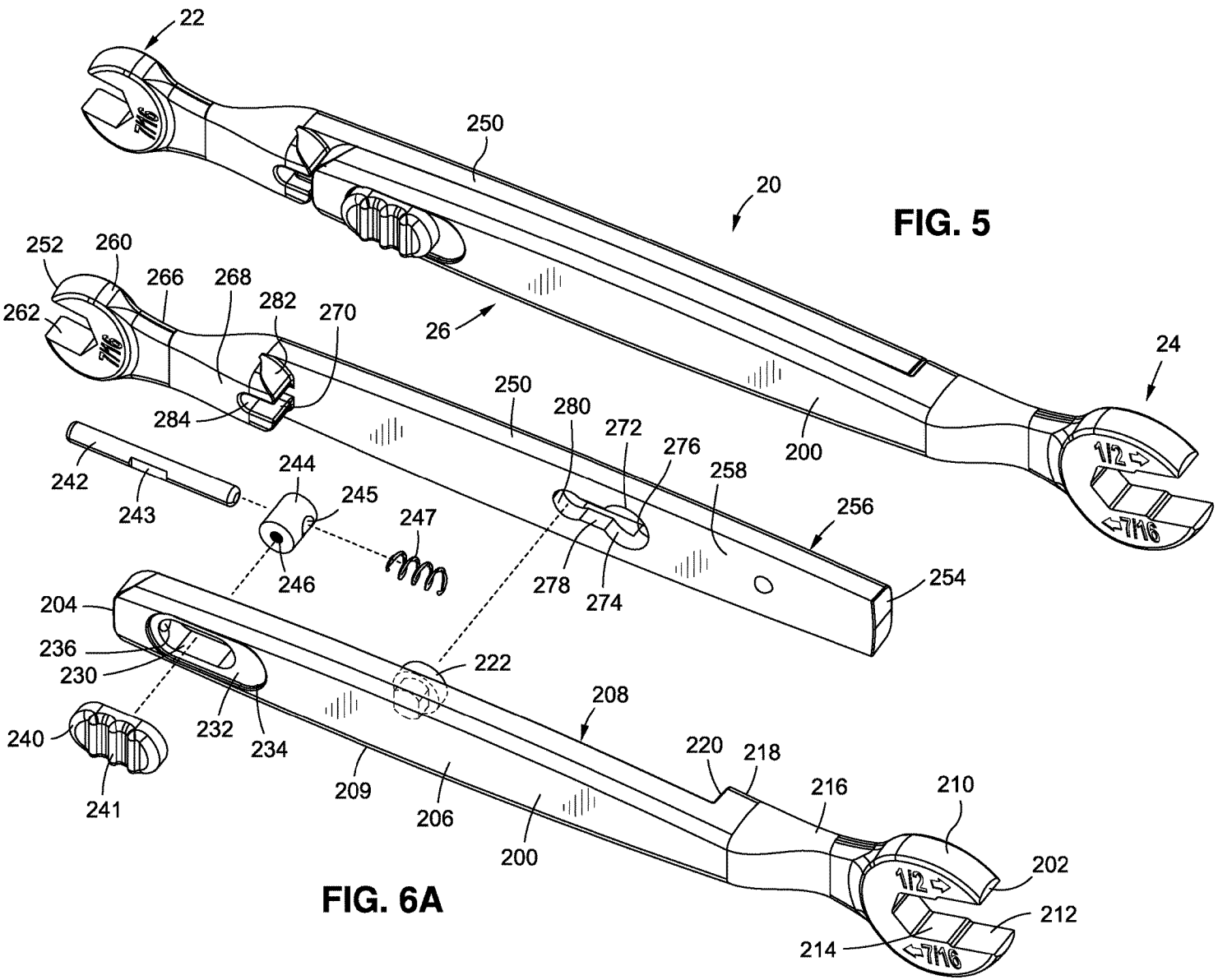
FIG. 5 shows a double-sided, detachable wrench in a connected state, according to one exemplary embodiment.
FIG. 6A, FIG. 6B, and FIG. 6C show views of the double-sided, detachable wrench of FIG. 5 in a detached state and disassembled state

FIG. 5 shows a double-sided, detachable wrench in a connected state, according to one exemplary embodiment. A wrench 20 comprises a first end 22, a second end 24, and a handle 26. The wrench 20 is comprised of two, detachable parts including a first wrench half 200 and a second wrench half 250. The connection between the first wrench half 200 and the second wrench half 250 allow for a smooth and ergonomic handle 26, as shown in FIG. 5.

Figure 6B:
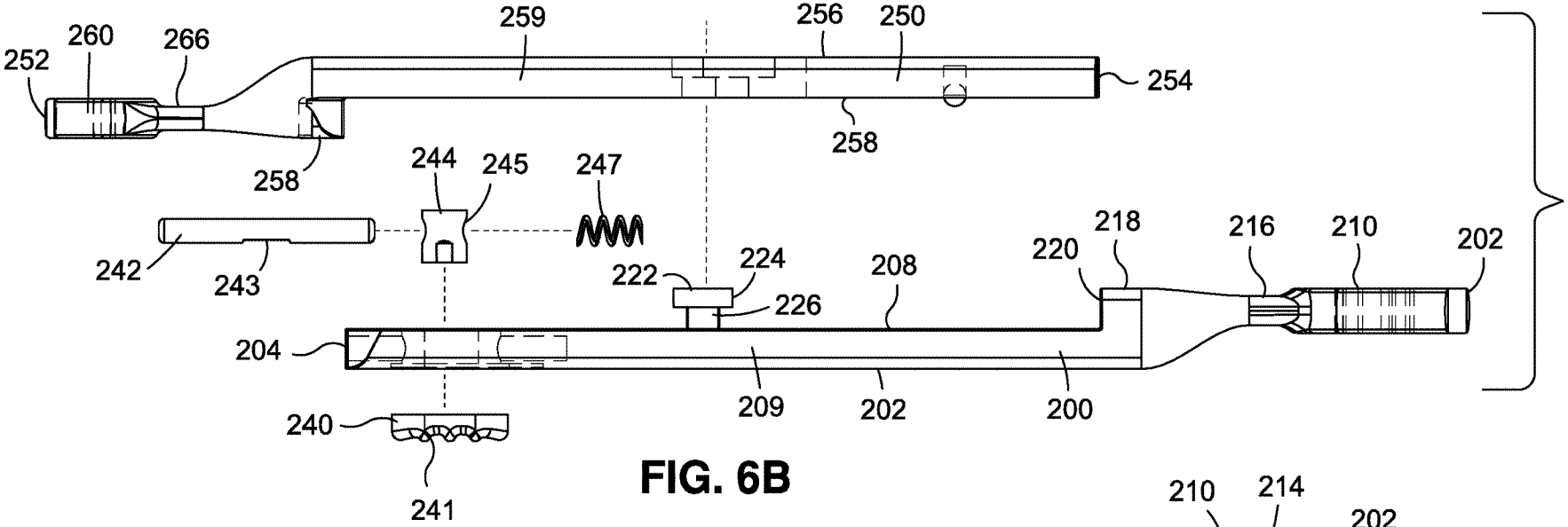
Figure 6C:
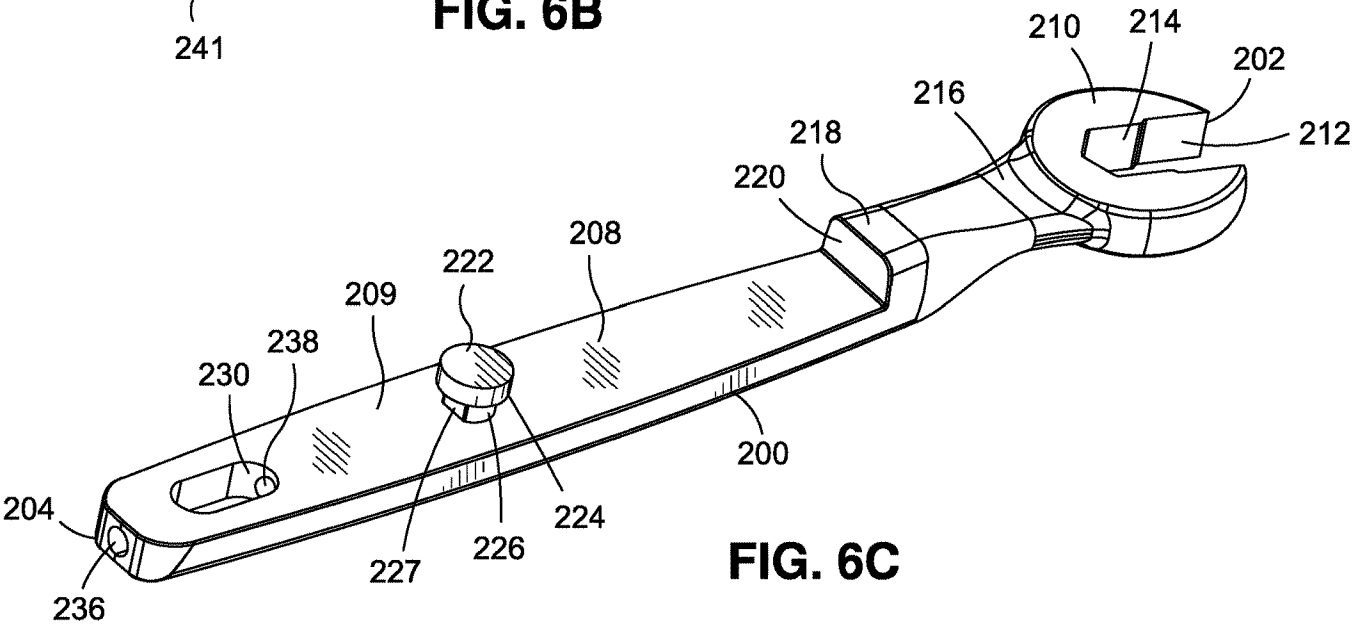
Figure 7:
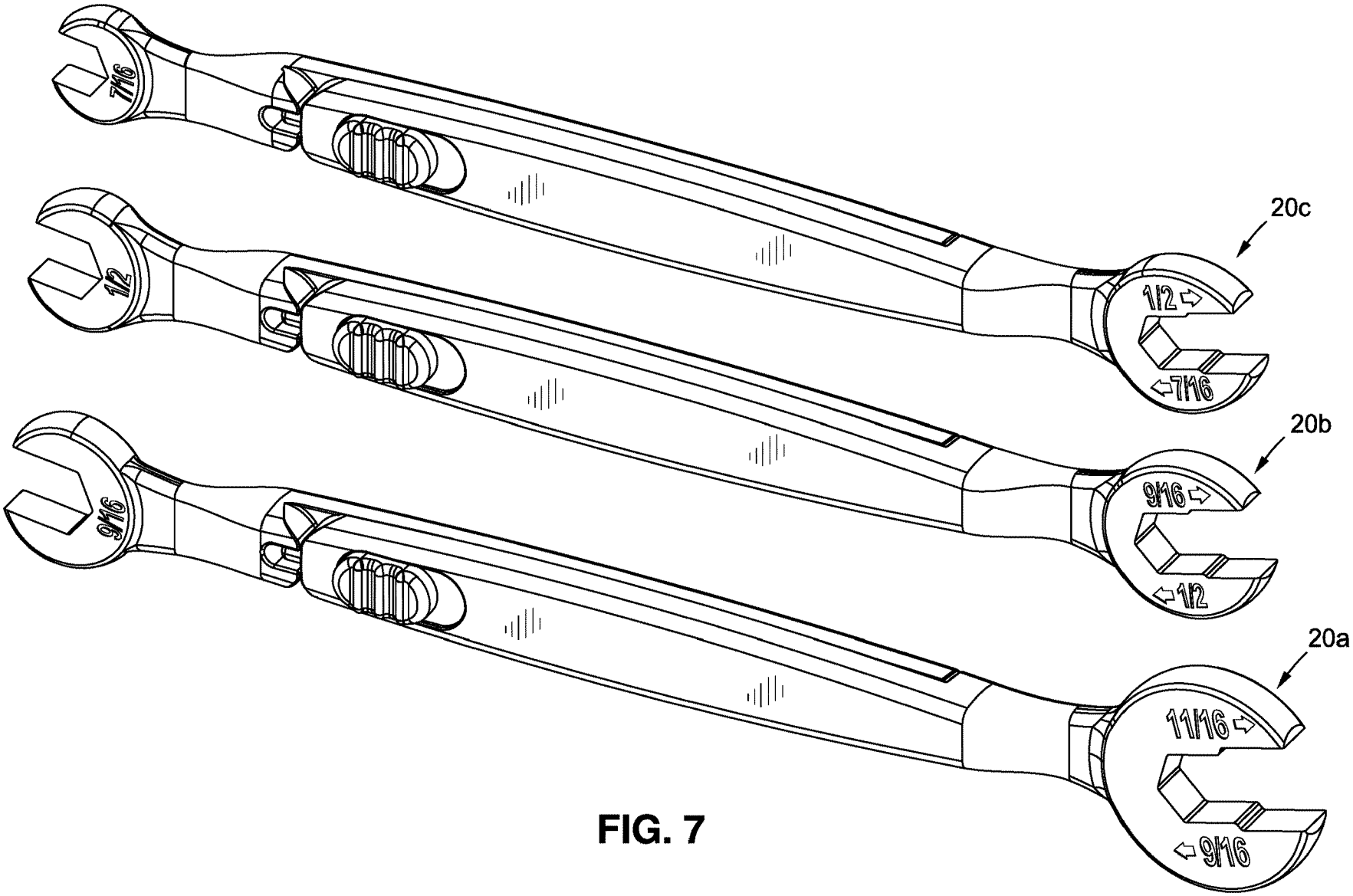
FIG. 7 shows exemplary sizing of a set of double-sided, detachable wrenches, according to an exemplary embodiment.

FIG. 6A and FIG. 6B show views of the double-sided, detachable wrench of FIG. 5 in a detached state and disassembled state. FIG. 6C shows a perspective view of the first wrench half. As mentioned above the wrench 20 includes a first wrench half 200 and a second wrench half 250. The first wrench half 200 comprises a first end 202, a second end 204 opposite the first end 202, a top face 206, and a bottom face 208 opposite the top face 206. The first end 202 comprises a tool head 210. A handle portion 209 extends from the tool head 210 toward the second end 204.

In this embodiment, the tool head 210 comprises a first opening 212 having a first size, and a second opening 214 having a second size that is smaller than the first size. The first and second openings are preferable sized to fit standard fasteners, such as described above with reference to Tables 1 and 2. In one example, the sizes may be ½ of an inch and 7/16 of an inch, respectively.

The first wrench half 200 further comprises a neck portion 216 that serves as a transition from the tool head 210 to the handle portion 209. The handle portion 209 forms one half of the handle 26 (See FIG. 5). The handle portion 209 is formed such that the bottom face 208 comprises a stepped portion 218. The handle portion 209 thus has a first thickness at the stepped portion 218 that is substantially the same thickness as the entire handle 26 (See FIG. 5) and a second thickness from the stepped portion 218 towards the second 204. The second thickness is approximately half of the first thickness.

The first wrench half 200 further comprises a latch 222 extending from the bottom face 208. The latch 222 has a keyed extension 226 shaped substantially cylindrical with parallel flat surfaces 227 formed on two sides thereof (see FIG. 6C). An annular flange 224 is formed on top of the keyed extension 226. The latch 222 helps connect the first wrench half 200 to the second wrench half 250.

Toward the second end 204, the first wrench half 200 comprises an elongated aperture 230 with a counterbore 232 forming an edge 234 surrounding the counterbore 232. A longitudinal hole 204 extends from the elongated aperture 230 to the second end 204. As shown in FIG. 6C, a blind hole 238 is formed in a wall of the elongated aperture 230 opposite from and in line with the longitudinal hole 236.

The elongated aperture 230 is configured to house a catching mechanism. The catching mechanism comprises a catch release switch 240. The catch release switch 240 may comprise ridges 241 on an outer surface to enhance a user's ability to grip the catch release switch. In some embodiments, the catch release switch may be formed from a plastic material and may be molded or die cast. A cylindrical catch rod 242 is provided which includes a flat face 243. The flat face may receive a set screw (not shown) to secure the catch rod 242 to the catching release switch 240. A cylindrical extension 244 is also provided. The cylindrical extension 244 may be attached to the catch release switch 240 or may be formed integrally therewith. The cylindrical extension 244 includes a threaded aperture 246 to receive the set screw and a lateral through hole 245 accommodating the catch rod 242. A spring 247 is provided to bias against the catch rod 242.

The catch release switch 240 is placed on the counterbore 232 such that the edge 234 limits the longitudinal motion of the catch release switch 240 relative to the handle 209 of the first wrench half 200. The cylindrical extension 233 extends into the elongated aperture 230, and the catch rod is placed through the longitudinal hole 236 on the second end 204 of the first wrench half 200, through the lateral through hole 245 of the cylindrical extension, and into the blind hole 238. The spring 247 is also placed in the blind hole and biases the catch rod 242 toward the second end 204 of the first wrench half 200. The catching mechanism is configured to lock the first wrench half 200 and the second wrench half 250 together when the first wrench half 200 and the second wrench half 250 are in the connected position, as will be described in more detail below.

Referring to FIGS. 6A and 6B, the second wrench half 250 comprises a first end 252, a second end 254 opposite the first end 252, a top face 256, and a bottom face 258 opposite the top face 256. The first end 252 comprises a tool head 260. A handle portion 259 extends from the tool head 260 toward the second end 254.

In this embodiment, the tool head 260 may be of a corresponding size to the tool head 210 on the first wrench half 200. In this example, the tool head 260 may have an opening 262 with a width of 9/16 corresponding to the tool head 210 and as noted in Table 2 above for a ¼-inch fastener.

The second wrench half 250 further comprises a neck portion 266 that serves as a transition from the tool head 250 to the handle portion 259. The handle portion 259 forms one half of the handle 26 (See FIG. 5). As shown in FIGS. 6A and 6B, the handle portion 259 is formed such that the bottom face 258 comprises a stepped portion 268. The handle portion 259 thus has a first thickness at the stepped portion 268 that is substantially the same thickness as the entire handle 26 (See FIG. 5) and a second thickness from the stepped portion 268 towards the second end 254. The second thickness is approximately half of the first thickness.

As shown in FIG. 6A, the stepped portion 268 has a raised profile 270. The raised profile 270 comprises a rounded cam surface 282 and a u-shaped slot 284. The raised profile 270 aids in securing the two wrench halves 200, 250 together in the connected state, as will be described in more detail below. The second wrench half 250 further comprises a latching aperture 272 extending through the bottom face 258 to the top face 256. The latching aperture 272 is counterbored to form a sunken, flanged profile 274. The flanged profile 274 comprises a large annular aperture 276, a slot 274, and a small annular aperture 280.

The second end 254 of the second wrench half 250 is formed to fit adjacent to the profile 220 of the stepped portion 218 of the first wrench half 200. When the second end 254 of the second wrench half 250 is adjacent to the stepped portion 218 of the first wrench half 200, the top surface 256 of the second wrench half 200 and the bottom surface 208 of the first wrench half are flush with each other.

When detaching or reattaching the first wrench half 200 from the second wrench half 250, the latch 222 and the latching aperture 272 function similar to the latch 122 and latching aperture 172 described above, and thus a description of how these features operate is omitted here.

When the first wrench half 200 and the second wrench half 250 are in the connected position, the second end 254 of the second wrench half 250 is adjacent to the stepped portion 2180 of the first wrench half 200. Similarly, the second end 204 of the first wrench half 200 is adjacent to the stepped portion 268 of the second wrench half 250. When in this position, the spring 247 biases the catch rod 242 into the slot 284 of the raised profile 270. This prevents relative rotation of the first and second wrench halves 200, 250 to keep them locked together.

To disconnect the first wrench half 200 from the second wrench half 250, the catch release switch 250 is moved away from the second end 204 of the first wrench half 200. This in turns pulls the catch rod 242 out of the slot 284 so that the first wrench half 200 may rotate to a perpendicular position relative to the second wrench half 250. In this position, the first wrench half 200 may be removed from the second wrench half 250 in a manner as described above.

When reattaching the first wrench half 200 to the second wrench half 250, the first wrench half 200 is rotated towards the connected position to be in line with the second wrench half 250. The spring 247 biases the catch rod 242 to protrude from the longitudinal hole 236 at the second end 204 of the first wrench half 200. As the catch rod 242 approaches the raised profile 270 of the stepped portion 268 of the second wrench half 250, the cam surface 282 forces the catch rod 242 into the longitudinal hole 242. Once the first wrench half 200 and the second wrench half 250 are substantially aligned, the catch rod 242 becomes aligned with the u-shaped slot 284 and the spring 247 biases the catch rod 242 into the slot 284, again locking the wrench halves 200, 250.

The above described embodiments thus provide a convenient and easily carried tool that can be used as a traditional double-sided tool, or that can be separated to use both sides of the tool simultaneously. The connection between the tool halves is both secure and convenient while maintaining the ergonomics of the handle of the tool when the tool halves are connected. Further, the tool is easier to manufacture that previous detachable tools.

As shown in FIG. 7, the above-described tools may be provided in sets to cover different sizes of fasteners. In the case of common household fasteners, three sizes of wrenches, 20*a*, 20*b*, and 20*c* may be provided in accordance with Tables 1 and 2 above, for example.

Based on all the foregoing, various aspects of the disclosed embodiments will now be appreciated. Embodiments comprise a double-ended, double-sided wrench, the wrench comprising first and second wrench halves. In one embodiment, each wrench half comprises a head and handle, wherein the handles of the two wrench halves cooperate to form a combined handle of the entire wrench when the two wrench halves are connected. In one embodiment, the handles of the wrench halves generally comprise half portions of the entire wrench handle, such as where the entire wrench handle is generally split down a longitudinal midline of the wrench handle. In one embodiment, the handles of the wrench halves are elongate so as to easily be gripped when a user is using each wrench half separate from the other. In addition, the handles of the wrench halves then overlap and extend along one another in the longitudinal direction to form the combined or unitary wrench half. In one embodiment, the handle of each wrench half has a length generally equal to the length between the neck portions of the wrench halves.

In one embodiment, the wrench is configured with means for detachably connecting the first and second wrench halves. As indicated, this means may comprise a latch, such as where the latch permits pivoting of the first and second wrench halves relative to one another, and then permits linear movement of the first and second wrench halves to allow their decoupling. Further, a means for locking or securing, such as in the form of the described catch, may be used to maintain the wrench halves in their connected position.

Of course, other means for detachably connecting might be provided. For example, one wrench half might define an elongate slot and the other wrench half might define one or more pins or ribs, wherein the pins or ribs might slide linearly into engagement with the elongate slot, thus connecting the first and second wrench halves. One or more transverse actuating pins or buttons might be movable to a position in which the pin or button extends from one wrench half into the other, thus locking them together in a manner then preventing them from being moved linearly relative to one another (thus preventing their decoupling). In another embodiment, one or more collars or similar members might be slidably mounted on one or both of the wrench halves, wherein once the handles of the wrench halves are placed next to one another, the collar(s) might be moved into a position over both halves, thus preventing them from decoupling. In yet another embodiment, the portion of each wrench half adjacent to the neck might define a recess for accepting the handle end of the other wrench half, allowing the wrench halves to be detachably connected. One or more locking means, such as a catch, pin/button or collar might then be used to prevent the linear movement of the wrench halves to a decoupled position.

In a preferred embodiment, each wrench half defines an open-ended tool head. However, the tool heads might have other configurations, such as closed or box-end tool heads or even other types of tool heads, such as socket-type heads, drivers and the like.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A double-sided, detachable tool comprising:

a first tool half having a first end, a second end opposite the first end, a top surface, and a bottom surface opposite the top surface, the first tool half comprising:

a first tool head disposed at the first end of the first tool half, a first stepped profile disposed on the bottom surface of the first tool half, and a latch disposed on the bottom surface of the first tool half; and a second tool half having a first end, a second end opposite the first end, a top surface, and a bottom surface opposite the top surface, the second tool half comprising a second tool head disposed at the first end of the second tool half, a second stepped profile disposed on the bottom surface of the second tool half, and a latching aperture extending through the second tool half from the top side to the bottom side;

the latch being inserted into the latching aperture to connect the first tool half to the second tool half and being removed from the latching aperture to detach the first tool half from the second tool half; and when connected, the second end of the first tool half being adjacent to the second stepped profile of the second tool half, wherein the top surface of the first tool half is substantially flush with the second stepped profile of the second tool half, and the second end of the second tool half being adjacent to the first stepped profile of the first tool half, wherein the top surface of the second tool half is substantially flush with the first stepped profile of the first tool half.

2. The double-sided, detachable tool of claim 1, wherein the latching aperture comprises a counterbored, flanged profile, the flanged profile comprising a large annular profile, a small annular profile, and a slot extending between the large annular profile and the small annular profile; wherein the latch comprises an annular flange disposed on a keyed extension comprising two parallel flat surfaces, and wherein the annular flange is configured to fit into the large annular profile and the two parallel flat surfaces are configured to fit into the slot.

3. The double-sided, detachable tool of claim 2, wherein when the first tool half is connected to the second tool half, a top of the annular flange is substantially flush with the top surface of the second tool half.

4. The double-sided, detachable tool of claim 2, wherein the two parallel flat surfaces only fit into the slot when the first tool half is substantially perpendicular to the second tool half.

5. The double-sided, detachable tool of claim 1, wherein the first stepped profile of the first tool half comprises a z-shaped profile, and the second end of the second tool half is formed in a corresponding z-shaped profile to the z-shaped profile of the first tool half.

6. The double-sided, detachable tool of claim 1, wherein the first tool head disposed on the first end of the first tool half comprises a first opening having a first size and a second opening having a second size.

7. The double sided, detachable tool of claim 6, wherein the second tool head disposed on the first end of the second tool half comprises a multi-point box head.

8. The double-sided, detachable tool of claim 6, wherein the second tool head disposed on the second end of the second tool half comprises a third opening having the second size.

9. The double-sided, detachable tool of claim 1, wherein the first tool half comprises a catch rod disposed at the second end of the first tool half, the catch rod being biased outward from the second end of the first tool half, wherein the second stepped profile of the second tool half comprises a u-shaped slot, and wherein the catch rod is biased into the u-shaped slot when the first tool half is connected to the second tool half.

10. The double-sided, detachable tool of claim 9, wherein the first tool half comprises a catch release switch connected to the catch rod, the catch release switch being operable to move the catch rod out of the u-shaped slot and into the second end of the first tool half enabling relative rotation between the first tool half and the second tool half.

11. A double sided, detachable tool comprising:

a first tool half having a first end, a second end opposite the first end, a top surface, and a bottom surface opposite the top surface, the first tool half comprising:

a first tool head disposed at the first end of the first tool half, a first stepped profile disposed on the bottom surface of the first tool half, the first stepped profile being formed in a z-shape, and a latch disposed on the bottom surface of the first tool half; and a second tool half having a first end, a second end opposite the first end, a top surface, and a bottom surface opposite the top surface, the second tool half comprising a second tool head disposed at the first end of the second tool half, a second stepped profile disposed on the bottom surface of the second tool half, and a latching aperture extending through the second tool half from the top side to the bottom side;

the latch being inserted into the latching aperture to connect the first tool half to the second tool half and being removed from the latching aperture to detach the first tool half from the second tool half;

the second end of the second tool half being formed in a corresponding z-shaped profile to the first stepped profile, the corresponding z-shaped profile being adjacent to the first stepped profile when the first tool half is connected to the second tool half.

12. The double-sided, detachable tool of claim 11, wherein when the first tool half is connected to the second tool half, the second end of the first tool half is adjacent to the second stepped profile of the second tool half, the top surface of the first tool half being substantially flush with the second stepped profile of the second tool half, and the top surface of the second tool half being substantially flush with the first stepped profile of the first tool half.

13. The double-sided, detachable tool of claim 11, wherein the latching aperture comprises a counterbored, flanged profile, the flanged profile comprising a large annular profile, a small annular profile, and a slot extending between the large annular profile and the small annular profile; wherein the latch comprises an annular flange disposed on a keyed extension comprising two parallel flat surfaces, and wherein the annular flange is configured to fit into the large annular profile and the two parallel flat surfaces are configured to fit into the slot.

14. The double-sided, detachable tool of claim 13, wherein when the first tool half is connected to the second tool half, a top of the annular flange is substantially flush with the top surface of the second tool half.

15. The double-sided, detachable tool of claim 13, wherein the two parallel flat surfaces only fit into the slot when the first tool half is substantially perpendicular to the second tool half.

16. A double sided, detachable tool comprising:

a first tool half having a first end, a second end opposite the first end, a top surface, and a bottom surface opposite the top surface, the first tool half comprising:

a first tool head disposed at the first end of the first tool half, a first stepped profile disposed on the bottom surface of the first tool half, a latch disposed on the bottom surface of the first tool half, and a catch rod disposed at the second end of the first tool half, the catch rod being biased outward from the second end of the first tool half; and a second tool half having a first end, a second end opposite the first end, a top surface, and a bottom surface opposite the top surface, the second tool half comprising a second tool head disposed at the first end of the second tool half, a second stepped profile disposed on the bottom surface of the second tool half, the second stepped profile of the second tool half comprising a u-shaped slot, and a latching aperture extending through the second tool half from the top side to the bottom side;

the latch being inserted into the latching aperture to connect the first tool half to the second tool half and being removed from the latching aperture to detach the first tool half from the second tool half; and the catch rod being biased into the u-shaped slot when the first tool half is connected to the second tool half.

17. The double-sided, detachable tool of claim 16, wherein when the first tool half is connected to the second tool half, the second end of the first tool half is adjacent to the second stepped profile of the second tool half, the top surface of the first tool half being substantially flush with the second stepped profile of the second tool half, and the second end of the second tool half is adjacent to the first stepped profile of the first tool half, the top surface of the second tool half being substantially flush with the first stepped profile of the first tool half.

18. The double-sided, detachable tool of claim 16, wherein the latching aperture comprises a counterbored, flanged profile, the flanged profile comprising a large annular profile, a small annular profile, and a slot extending between the large annular profile and the small annular profile; wherein the latch comprises an annular flange disposed on a keyed extension comprising two parallel flat surfaces, and wherein the annular flange is configured to fit into the large annular profile and the two parallel flat surfaces are configured to fit into the slot.

19. The double-sided, detachable tool of claim 18, wherein when the first tool half is connected to the second tool half, a top of the annular flange is substantially flush with the top surface of the second tool half.

20. The double-sided, detachable tool of claim 18, wherein the two parallel flat surfaces only fit into the slot when the first tool half is substantially perpendicular to the second tool half.

* * * * *